US005098222A

United States Patent [19]

Robinson

[11] Patent Number: 5,098,222

[45] Date of Patent: Mar. 24, 1992

[54] WAVE GENERATOR

[75] Inventor: Alan S. Robinson, El Monte, Calif.

[73] Assignee: Wet Design, Universal City, Calif.

[21] Appl. No.: 416,988

[22] Filed: Oct. 2, 1989

[51] Int. Cl.[5] ..... E04H 3/18
[52] U.S. Cl. ..... 405/79; 4/491
[58] Field of Search ..... 405/52, 76, 79; 4/491

[56] References Cited

U.S. PATENT DOCUMENTS 4,522,535 6/1985 Bastenhof ..... 405/79
4,539,719 9/1985 Schusler et al. ..... 405/79 X

FOREIGN PATENT DOCUMENTS 2004528 8/1971 Fed. Rep. of Germany ..... 4/491
0057706 3/1986 Japan ..... 405/79

*Primary Examiner*—Dennis L. Taylor
*Assistant Examiner*—Arlen L. Olsen
*Attorney, Agent, or Firm*—Blakely, Sokoloff, Taylor & Zafman

[57] ABSTRACT

A wave generator for generating waves in pools and the like for water sports, amusement and the like. The wave generator has a water inlet/outlet disposed and configured so that when acting as an inlet, it will draw water from the pool and not air from above the pool. The wave generator includes a sealable chamber coupled to the water inlet/outlet for temporary storage of a substantial quantity of water at elevations above the level of water in the pool. In operation the chamber is sealed and air is pumped therefrom by a suitable air pump, by an entrainment device or other equipment, substantially filling the chamber with water from the pool. To generate a wave, the upper part of the chaber is then vented to the atmosphere, allowing the water in the chamber to rush out through the inlet/outlet thereof, with the sudden rush of water generating the desired wave. Various embodiments are disclosed.

15 Claims, 1 Drawing Sheet

WAVE GENERATOR

BACKGROUND OF THE INVENTION

1. Field of the Invention

A wave generator for generating waves in pools and the like for water sports, amusement and the like.

2. Prior Art

Wave generators of various types are well-known in the prior art, typically being used in pools in water parks and the like to generate waves of substantial size therein for the enjoyment of the persons using the pool. Devices of this type include moveable wall panel-like members disposed substantially vertically and moved back and forth in a horizontal direction perpendicular to the plane of the wall-like member to create waves in a cyclical manner. Such a mechanism, of course, is relatively large, and takes a substantial amount of power, as the wave generator is in effect in continuous operation. It also requires maintenance because of the substantial number of moving parts and the resulting loads and wear thereon, and of course must be adequately shielded or separated from the persons using the pool to avoid any inadvertent injury thereto.

Another type of wave generator which is used is a tilting trough type of generator. In this type, an open box or trough-like container is disposed above the level of water in the pool and is slowly filled therefrom by an appropriate, relatively high volume low pressure water pump such as a pool water circulating pump. When the container is substantially filled with water, the same is dumped into the pool, thereby creating the desired wave action. Dumping may be achieved by opening the adjacent side wall of a container or alternatively, tilting the container about a longitudinal axis to pour the water therefrom. If desired, a pivoted container of appropriate shape and balance will automatically dump when a predetermined water level is obtained, and right itself after dumping for refilling. Such a technique has the advantage of requiring less power and substantially less mechanism than the previously discussed wave generator, though does require either dumping of a very heavy container of water when filled, or alternatively the controlling of a wall of such a container at a time when it has tremendous hydraulic forces thereon.

The present invention provides a wave generator having many of the characteristics and advantages of this latter type of wave generator, though with greater flexibility in the operation thereof and without the major mechanical problems thereof.

BRIEF DESCRIPTION OF THE INVENTION

A wave generator for generating waves in pools and the like for water sports, amusement and the like. The wave generator has a water inlet/outlet disposed and configured so that when acting as an inlet, it will draw water from the pool and not air from above the pool. The wave generator includes a sealable chamber coupled to the water inlet/outlet for temporary storage of a substantial quantity of water at elevations above the level of water in the pool. In operation the chamber is sealed and air is pumped therefrom by a suitable air pump, by an entrainment device or other equipment, substantially filling the chamber with water from the pool. To generate a wave, the upper part of the chamber is then vented to the atmosphere, allowing the water in the chamber to rush out through the inlet/outlet thereof, with the sudden rush of water generating the desired wave. Various embodiments are disclosed.

DETAILED DESCRIPTION OF THE INVENTION

Figure 1:
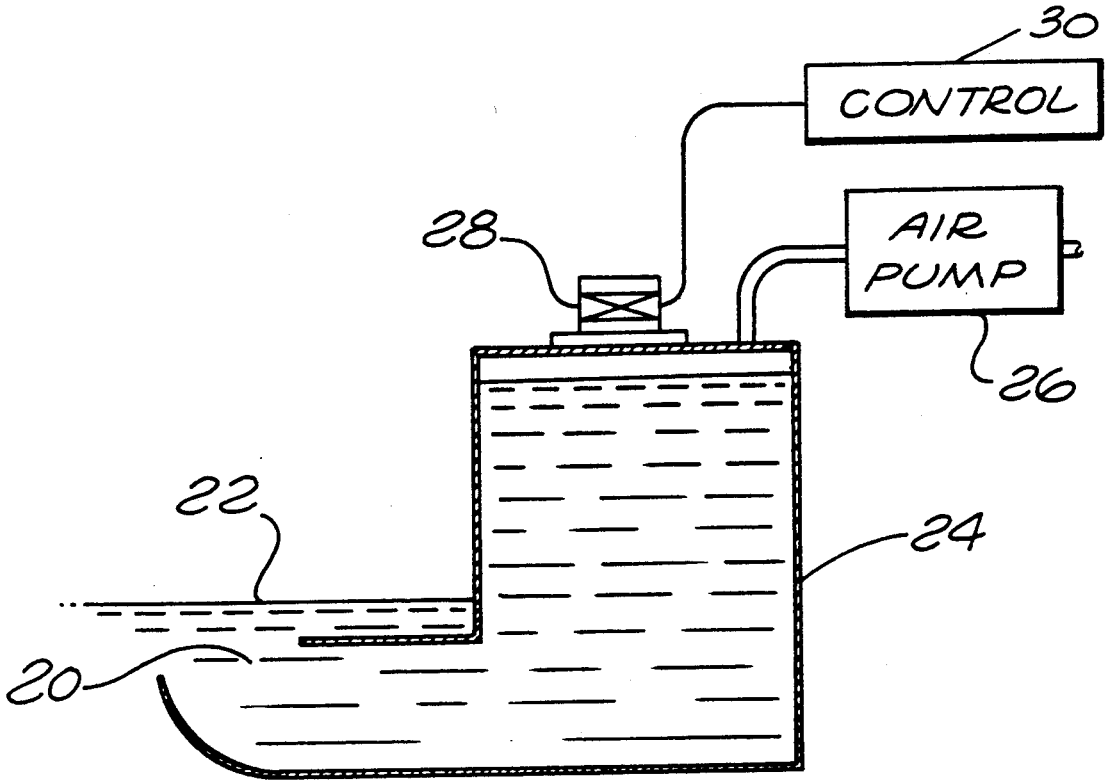
FIG. 1 is a schematic cross-section of a typical embodiment of the present invention.

Referring to FIG. 1, a schematic cross-section of a typical embodiment of the present invention may be seen. As shown therein, the wave generator has a water inlet/outlet 20 which in this embodiment is disposed slightly below the level of water 22 in the pool in which it is used. The inlet/outlet is in direct and substantially unrestricted fluid communication with a chamber 24 of some substantial size and rising some significant height above the level of the water inlet/outlet 20 and the level of the water 22 in the pool. By way of specific example, chamber 24 may extend upward on the order of 15 feet or more above the level of the water 22.

Chamber 24 is sealed except for certain openings at the top thereof, the function of which will be subsequently described, and has a substantial cross-sectional area so as to be able to contain a substantial amount of water per unit length of the wave generator. In that regard, in the preferred embodiment, the wave generator has a substantially uniform cross-section of the geometry shown in FIG. 1 throughout the entire length thereof, which length, perhaps through the use of multiple units, may by way of example, extend all the way across the end of a pool. In a typical embodiment, by way of example, chamber 24 may have a horizontal width on the order of 20 feet, thereby giving the chamber 24 a capacity above the water level 22 of 300 cubic feet of water per lineal foot of wave generator. These dimensions, of course, may be altered as desired to give the desired result for any particular application. Also, if desired, and depending upon the length of the wave generator, or the length of each wave generator unit in a series of such devices, one may provide one or more tie-bar or horizontal braces between opposite walls of chamber 24 to prevent the same from flexing excessively in response to the varying pressures the same will be subjected to during the operating cycle of the device. Such braces, if of any substantial size, should be oriented so as to not restrict the water flow into and more importantly rapidly out of chamber 24 during the operating cycle of the device. In one embodiment of the invention, chamber 24 and the water inlet/outlet 20 are fabricated out of plywood, fiberglassed both internally and externally to reinforce and protect the same from the water.

Adjacent the top of chamber 24 is a first port coupled to an air pump 26, and a second relatively large port controlled by a solenoid operated valve 28, in turn electrically controlled by some form of control 30. In operation, valve 28 is closed and air pump 26 is turned on to exhaust air from chamber 24, drawing water out of the pool through the water inlet/outlet 20 and into chamber 24 from the bottom thereof. When chamber 24 is substantially filled, valve 28 is opened, venting the top of chamber 24 to the atmosphere. This allows the water in chamber 24 to freely surge downward and out through the water inlet/outlet 20 to build a large wave at the adjacent pool wall which then will travel along the length of the pool, to be absorbed or reflected from the other end of the pool depending upon the configuration of that pool end. Of course, upon closure of valve 28, chamber 24 will again start to refill as part of the next operating cycle.

While valve 28 is a relatively large valve, such as by way of example, a 6 inch valve, it is still orders of magnitude smaller than would be required to provide a direct valving action on the water itself. This of course is one of the advantages of the present invention, in that suitable controllable valves are readily commercially available for use in alternately sealing and venting chamber 24 to provide the desired result. Thus, much of the mechanical complexity of prior art wave generators is eliminated by merely controlling the presence or absence of reduced air pressure above the water in chamber 24, as opposed to trying to directly control the water flow itself. In essence, a much smaller valve may be used in the present invention for controlling the venting than would be required for controlling the water flow, as much much larger volumetric flow rates may be achieved for a given differential pressure across the valve for air flow than for water flow.

Air pump 26 may itself be any of various types of pumps. By way of example, the air pump could be a simple motor driven air pump of a suitable flow rate and pressure ratio. Some such pumps however, might be damaged by the ingestation of water, and accordingly if used, care must be taken to avoid such occurences, such as by placing the air pump at a height above chamber 24 above its ability to lift water, by turning the pump off when the water level in chamber 24 reaches a predetermined level, or by opening valve 28 to dump the water before ingestation may occur. In that regard, whatever is used for air pump 26, the same may or may not be turned off when valve 28 is opened, as valve 28 normally will have adequate air flow capacity to appropriately vent chamber 24 even if the air pump continues to pump at the much lower volumetric flow rate thereof.

Other types of air pumps of course may also be used. By way of specific examples, air entrainment devices operating off of the recirculating pool water have ideal characteristics, making the same the preferred form of air pump in at least some application. In particular, this form of air pump is readily commercially available and is not sensitive to the ingestation of water, and accordingly, its use presents no special limitations in this regard.

Figure 2:
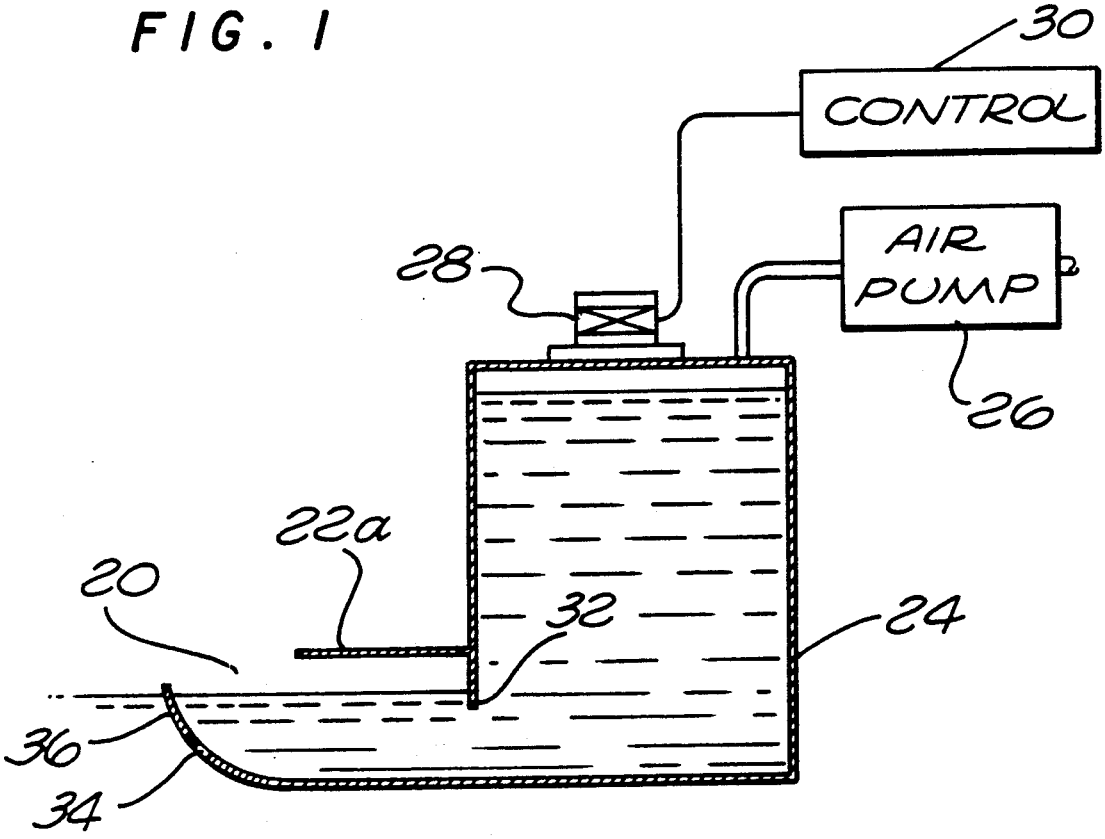
FIG. 2 is a schematic cross-section of an alternate embodiment of the present invention.

Now referring to FIG. 2, an alternate embodiment of the present invention may be seen. In general, this embodiment is very similar to that of FIG. 1, with parts having the same general design and function of those in FIG. 1 being given the same numerical identifications. In FIG. 2 however, the water level 22*a* is lower, so that the water surge ejected from the water inlet/outlet of the water generator is ejected substantially at the water level in the pool as opposed to being ejected somewhat below the water level, as in FIG. 1. In this case, a downward protrusion 32 on the front wall of chamber 24 is provided, which protrusion extends downward a sufficient distance to assure the lower end thereof is always below the water level 22 of the pool, thereby preventing chamber 24 from drawing air instead of water in through the water inlet/outlet 20. Also, a series of holes 34 are provided on the curved front portion 36 of the water inlet/outlet to prevent the same from acting as a dam to prevent water flow therethrough into chamber 24. These holes or openings 34 may be sufficiently small as to not significantly effect the operation of the system during the actual generation of a wave because the flow rate at that time is orders of magnitude larger than the flow rate during the refilling of the chamber. On the other hand, if desired, the same may be covered with some form of very simple flapper valve such as pieces of filament reinforced rubber which is encouraged to cover the holes during the discharge of the water to generate the wave, as the differential pressures thereon during wave generation are relatively low.

Also the control 30 may be any suitable type of control. By way of example, if the air pump 26 is an entrainment device, the control 30 might simple be an interval timer operating the wave generator repetitively at fixed intervals. If the air pump 26 is one which is sensitive to ingestation of water, control 30 might still be an interval timer, though perhaps operating on a somewhat shorter cycle. Alternatively in such a case, the control might be responsive to a float switch in chamber 24, again having the effect of controlling the maximum height of the water in chamber 24 to prevent the same from being ingested into the air pump 26. In the simplest form, control 30 might be simply a manual switch controlled by an instructor or lifeguard at the pool. At the other extreme wherein variation in the size and frequency of the waves was desired, including but not limited to water displays of an aesthetic character, the control 30 might be some form of computer control, varying the operating cycle as desired. In such event, the same might also control air pump 26 so that the longest cycle time was not always the largest wave generated, etc.

In a typical application, chamber 24 and the various parts of the wave generator associated therewith are normally disposed behind some wall or otherwise out of sight, so that the various functional parts of the wave generator other than the water inlet/outlet are not visible to the user or observer and accordingly generally need not be aesthetic in character. Obviously while two embodiments of the invention have been disclosed and described herein, it will be understood by those skilled in the art the various changes in form and detail may be made therein without departing from the spirit and scope thereof.

I claim:

1. A wave generator comprising:

a substantially unrestricted water inlet/outlet disposed in a pool of water said inlet/outlet being disposed above the water level of said pool;

a chamber in fluid communication with said water inlet/outlet through communication means below the level of the water in the pool, said chamber extending upward to a level substantially above the level of water in the pool of water;

means, extending through said inlet/outlet, for allowing water flow past said inlet/outlet in a direction towards said chamber, a valve means coupled to said chamber and controllably operable between an open position venting said chamber to the atmosphere and a closed position preventing airflow therethrough; and, air pump means coupled to said chamber for removing air therefrom;

whereby water may be drawn from the pool into said chamber by the removal of air therefrom by said air pump means, and quickly expelled therefrom through said inlet/outlet to generate a wave by opening said valve means to vent said chamber.

2. The wave generator of claim 1 wherein said water inlet/outlet curves upward so that water quickly expelled therefrom to generate a wave is expelled with a substantial upward component.

3. The wave generator of claim 1 wherein said valve means is an electrically controllable valve means.

4. The wave generator of claim 3 further comprised of control means for controlling said valve means.

5. A wave generator comprising:

a substantially unrestricted water inlet/outlet disposed in a pool of water said inlet/outlet being disposed above the water level of said pool;

a chamber in unrestricted water communication with said water inlet/outlet through communication means below the level of the water in the pool, said chamber extending upward to a level substantially above the level of water in the pool of water, extending through said inlet/outlet, and having the capacity to contain a substantial volume of water;

means for allowing water flow past said inlet/outlet in a direction towards said chamber;

a valve means coupled to said chamber and controllably operable between an open position venting said chamber to the atmosphere and a closed position preventing airflow therethrough; and, air pump means coupled to said chamber for removing air therefrom, said chamber being substantially air tight except for the connections for said valve means and said air pump means;

whereby water may be drawn from the pool into said chamber by the removal of air therefrom by said air pump means, and quickly expelled therefrom through said inlet/outlet to generate a wave by opening said valve means to vent said chamber.

6. The wave generator of claim 5 wherein said water inlet/outlet curves upward so that water quickly expelled therefrom to generate a wave is expelled with a substantial upward component.

7. The wave generator of claim 5 wherein said valve means is an electrically controllable valve means.

8. The wave generator of claim 7 further comprised of control means for controlling said valve means.

9. A method of generating waves in a pool of water comprising the steps of:

(a) providing:

(i) a substantially unrestricted water inlet/outlet disposed in the pool of water said inlet/outlet being disposed above the water level of said pool;

(ii) a chamber in fluid communication with said water inlet/outlet through communication means below the level of the water in the pool, said chamber extending upward to a level substantially above the level of water in the pool of water;

(iii) means for allowing water flow past said inlet/outlet in a direction towards said chamber;

(iv) a valve means coupled to said chamber and controllably operable between an open position venting said chamber to the atmosphere and a closed position preventing airflow therethrough; and, (v) air pump means coupled to said chamber for removing air therefrom;

(b) closing said valve means and operating said air pump means to withdraw air from the chamber to draw water through said means for allowing water flow from the pool of water; and, (c) opening said valve means to vent said chamber to the atmosphere, thereby allowing the water in said chamber to rush out through said inlet/outlet to generate a wave in the pool.

10. The method of claim 9 wherein the steps of the method are cyclically repeated.

11. The method of claim 9 wherein said air pump means is turned off before said valve means is opened.

12. The method of claim 9 wherein said air pump means is left on when said valve means is opened.

13. The method of claim 9 wherein said air pump means is an entrainment pump.

14. A wave generator comprising:

a substantially unrestricted water inlet/outlet disposed in a pool of water;

a chamber in fluid communication with said water inlet/outlet through communication means below the level of the water in the pool, said chamber extending upward to a level substantially above the level of water in the pool of water;

a valve means coupled to said chamber and controllably operable between an open position venting said chamber to the atmosphere and a closed position preventing airflow therethrough; and an entrainment pump coupled to said chamber for removing air therefrom;

whereby water may be drawn from the pool into said chamber by the removal of air therefrom by said entrainment pump, and quickly expelled therefrom through said inlet/outlet to generate a wave by opening said valve means to vent said chamber.

15. A wave generator comprising:

a substantially unrestricted water inlet/outlet disposed in a pool of water;

a chamber in unrestricted water communication with said water inlet/outlet through communication means below the level of the water in the pool, said chamber extending upward to a level substantially above the level of water in the pool of water and having the capacity to contain a substantial volume of water;

a valve means coupled to said chamber and controllably operable between an open position venting said chamber to the atmosphere and a closed position preventing airflow therethrough; and, an entrainment pump coupled to said chamber for removing air therefrom, said chamber being substantially air tight except for the connections for said valve means and said entrainment pump;

whereby water may be drawn from the pool into said chamber by the removal of air therefrom by said entrainment pump, and quickly expelled therefrom through said inlet/outlet to generate a wave by opening said valve means to vent said chamber.

* * * * *